United States Patent [19]

Fukumoto et al.

[11] Patent Number: 5,035,453

[45] Date of Patent: Jul. 30, 1991

[54] DOOR-LOCKING DEVICE

[75] Inventors: Ryoichi Fukumoto, Nagoya; Shigeru Hayakawa, Chiryu, both of Japan

[73] Assignee: Aisin Seiki Kabushiki Kaisha, Aichi, Japan

[21] Appl. No.: 496,974

[22] Filed: Mar. 22, 1990

[30] Foreign Application Priority Data

Mar. 24, 1989 [JP] Japan ..... 01-033859
Mar. 24, 1989 [JP] Japan ..... 01-033860

[51] Int. Cl.[5] ..... E05C 3/26
[52] U.S. Cl. ..... 292/336.3; 292/216
[58] Field of Search ..... 292/216, 280, 201, DIG. 26, 292/336.3

[56] References Cited

U.S. PATENT DOCUMENTS 3,309,127 3/1967 Pickles ..... 292/DIG. 26 X
3,695,662 10/1972 Ploughman ..... 292/DIG. 26 X
4,455,042 6/1984 Yamada ..... 292/216 X

*Primary Examiner*—Richard E. Moore
*Attorney, Agent, or Firm*—Finnegan, Henderson, Farabow, Garrett and Dunner

[57] ABSTRACT

In a door-locking device, an output lever is connected to a release member and other operating mechanisms in order to eliminate a locking lever and a locking link. The elimination of these members decreases the number of connecting portions between members or mechanisms, thereby decreasing loose fittings therebetween. Thus, the generation of noise is lowered resulting in the realization of quietude. Also, the sense of operation of the door-locking device is more comfortable due to the decreased feeling of looseness.

3 Claims, 18 Drawing Sheets

DOOR-LOCKING DEVICE

BACKGROUND OF THE INVENTION

1. Field of the invention

The present invention relates to a door-locking device.

2. Prior art

As shown in FIGS. 24 and 25, a conventional door-locking device has a main body 1 in which a mechanism for opening/closing the door is accomodated. On the main body 1, there is mounted a base 17. A lift-lever 12 which is operatively connected to the mechanism and an outer-lever 15 are rotatably mounted on the base 17. On the outer-lever 15, there is movably mounted a release member 25, which is engageble/disengageble with the lever 15. By adjusting the position of the release member 25, the rotational movement of the outer-lever 15 is or is not transmitted to the lift-lever 12.

Under the foregoing structure or construction, upon rotation of the outer-lever 15 while the release member 25 is in engagement with the lift-lever 12, the release member 25 is brought into engagement with the lift-lever 12, thereby rotating the lift-lever 12. Due to resulting rotation, the mechanism is operated and the door is ready for opening.

Further, a locking-lever 28 which is rotatably mounted on the base 17 is in engagement with the release member 25 via a locking link 32. The locking-lever 28 and the locking link 3 are connected with a first means 71 which is manually driven, and an output lever 52 of a second means 2 which is electrically operated. By operating the locking link 32 through either the first means 17 or the second means 2, the release member 25 is moved, thereby establishing or interupting the engagement between the release member 25 and the lift-lever 12.

However, in the foregoing construction, a connecting portion between the output lever 52 and the locking link 32, a connecting portion between the locking link 32 and the release member 25, a connecting portion between the locking-lever 28 and the locking link 32, and a pivot-portion of the locking-lever 28 generate noise, thereby violating calmness. Also, a loose in fit at each connecting portion gives a bad impression to the person who opens or closes the door.

SUMMARY OF THE INVENTION

It is, therefore, a principal object of the present invention to provide a door-locking device without aforementioned drawbacks.

In order to attain this object, a door-locking device is comprised of a main body accomodating a mechanism for opening/closing a door; a base mounted on the main body; a lift-lever rotatably mounted on the base for operating the mechanism; an outer-lever rotatably mounted on the base; a release member movably mounted on the outer-lever and engageble and disengageble with the lift-lever for enabling and preventing the transmission rotation the outer-lever to the lift-lever; and an output lever rotatably mounted on the base and connected to the release member so that it may establish and interrupt such transmission.

DETAILED DESCRIPTION OF THE PREFERRED EMBODIMENTS

Figure 1:
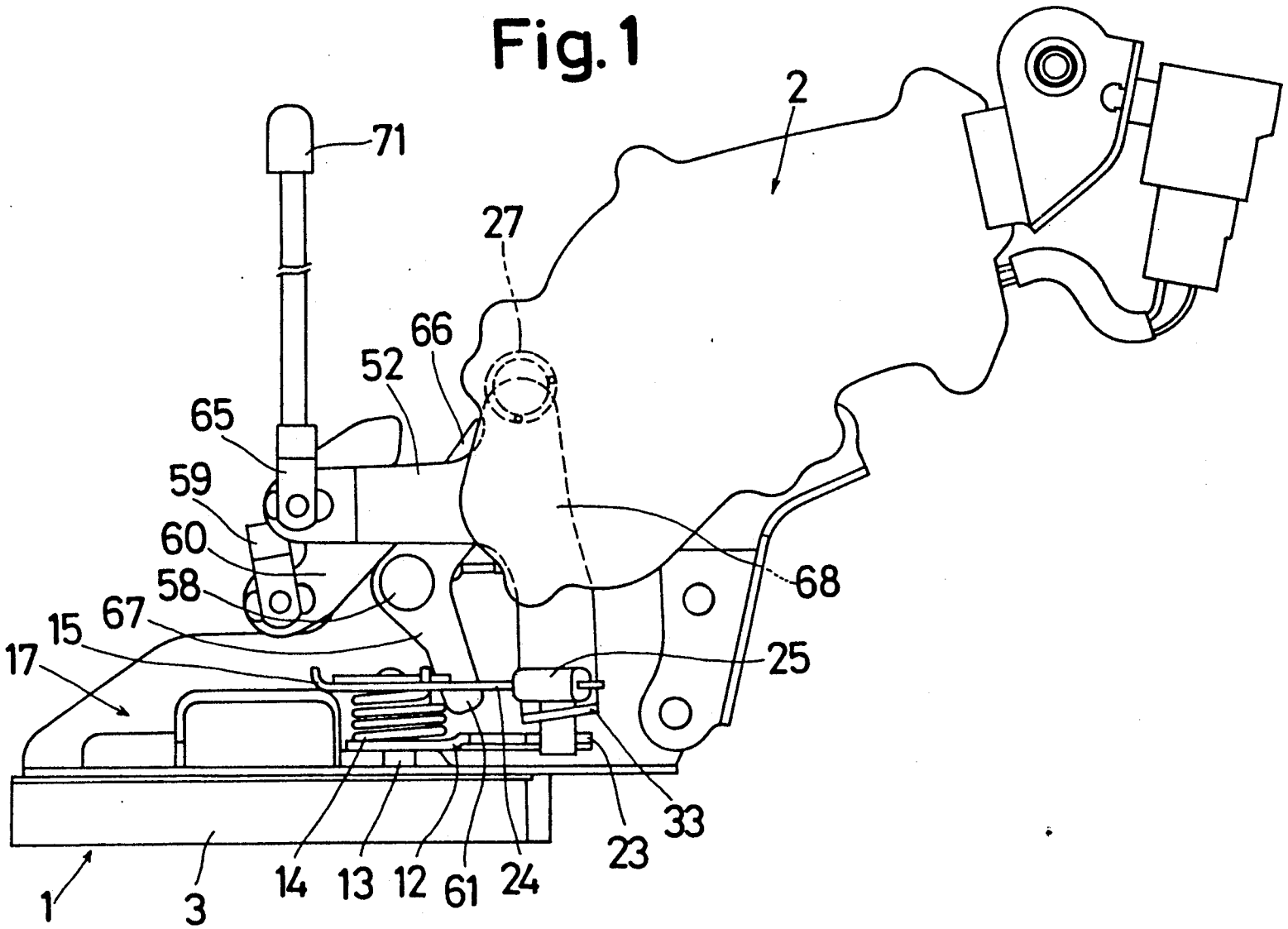
FIG. 1 is a front view of a door-locking device according to a first embodiment of the present invention.

Referring now to FIGS. 1 through 12, a first embodiment of the present invention is illustrated. As shown in FIGS. 1 through 4, a main body 1 of a door-locking device 10 is connected with an actuator 2 which brings a door (not shown) into a locked condition or an unlocked condition in the electrically driving manner.

Figure 5:
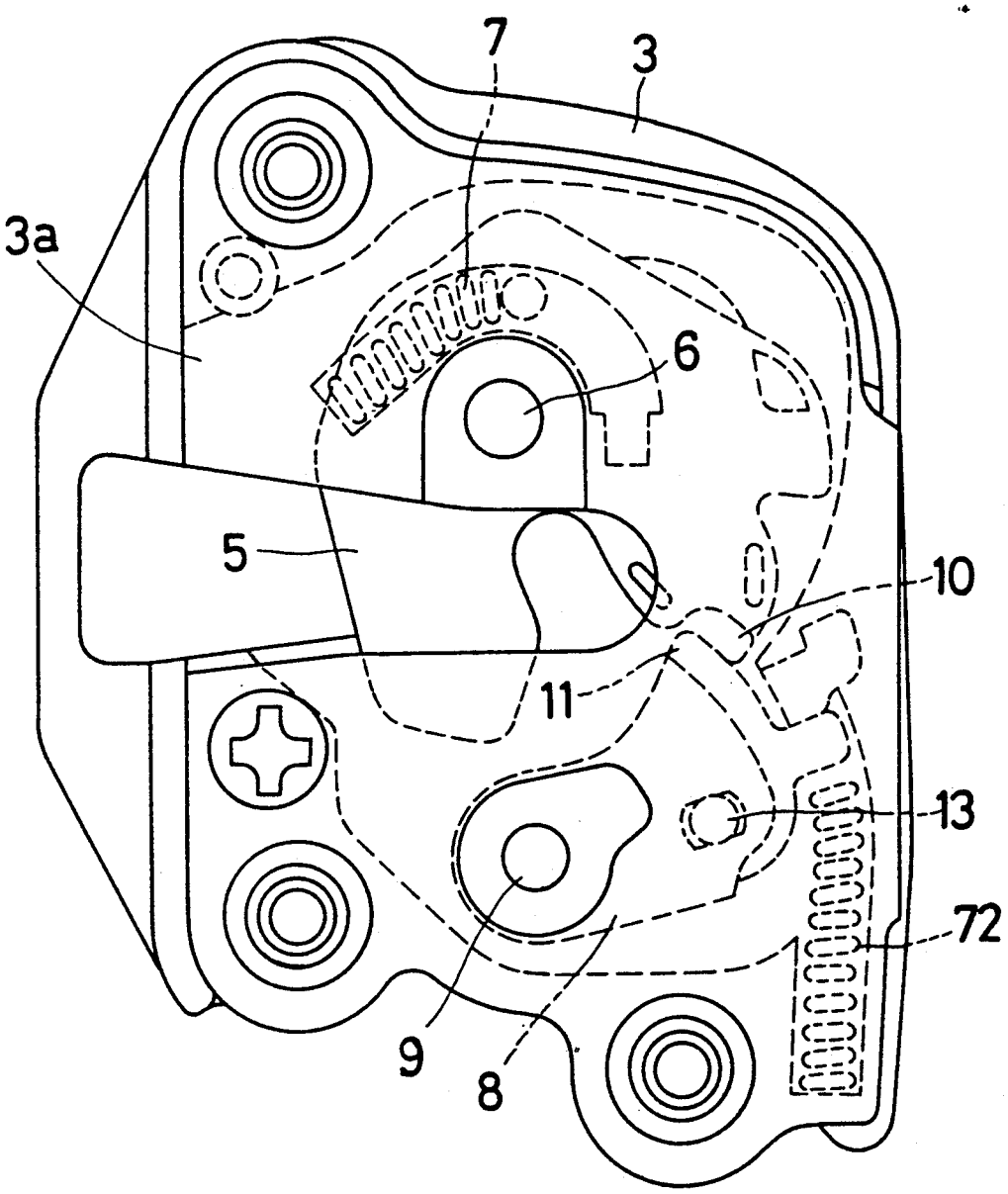
FIG. 5 is a plain view of a main body of the device.
Figure 6:
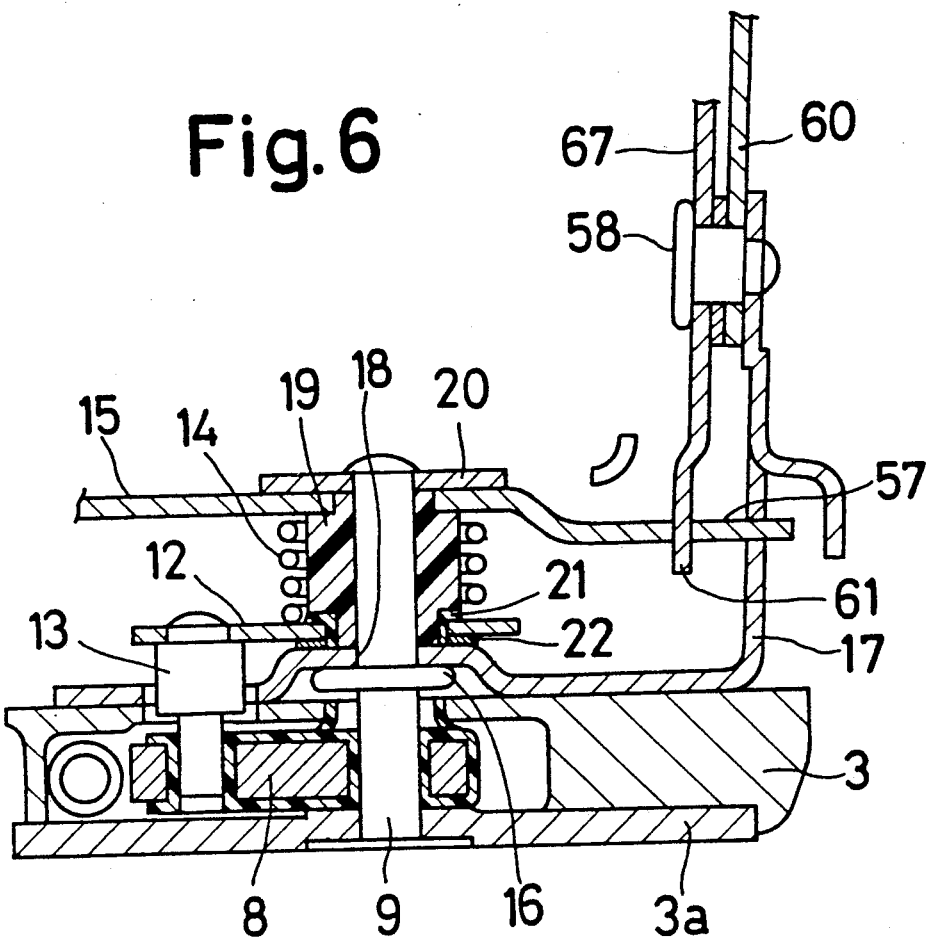
FIG. 6 is a cross-sectional view of the main body in FIG. 5.

As shown in FIGS. 5 and 6, a body 3 of the main body 1 and a cover 3*a* constitute therebetween a space in which a latch 5 and a pawl 8 are accomodated so that a clawed portion 10 of the latch 5 may be engageble with a clawed portion 11 of the pawl 8. The latch 5 is rotatably mounted on a pin 6 driven in the body 3 and is continually urged in the clockwise direction by a latch-spring 7 in FIG. 5. The pawl 8 is rotatably mounted on a pawl-pin 9 driven in the body 3 and is continually urged in the counter-clockwise direction by a pawl-spring 72 in FIG. 5. The latch 5, the pawl 8 and other members related thereto constitute a mechanism for opening/closing the door.

The pawl 8 receives a pin 13 connected to a lift-lever 12, thereby enabling the unitary movement of the pawl 8 and the lift-lever 13. The lift-lever 12 is movable together with or relative to an outer-lever 15 which is urged by a spring 14 on the pawl-pin 9. The pawl-pin 9 is provided with a flange 16. A lower end of the pawl-pin 9 is fitted in the pawl 8 and an upper end of the pawl-pin 9 is passed through a hole 18 of a base 18 and is fixedly mounted to the base 17 via a collar 19 about which the outer-lever 15 rotates and a washer 20. At a portion of the collar 19 about which the lift-lever 12 rotates, there are provided a resin-made bush 21 and a washer 22 so as to prevent the mechanical friction between the lift-lever 12 and the base 17.

Figure 7:
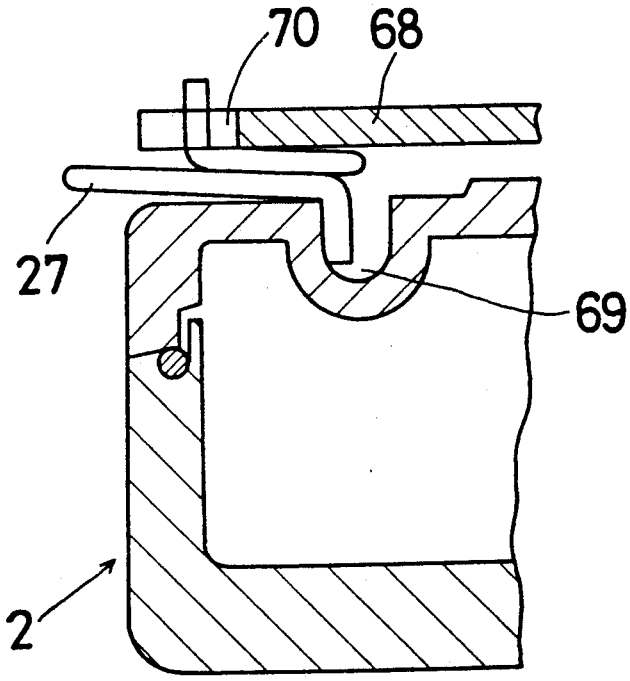
FIG. 7 is an enlarged view of a portion in FIG. 1 for showing the condition of the instllation of a turn-over spring.

As shown in FIGS. 1 through 4, on a pin 58 secured to the base 17, there is rotatably mounted an inner-lever 60 which is operatively connected to an inside-handle (not shown) via a snap 59. The inner-lever 60 is operatively connected to, via a release-bush 66 of a well-known child-protecting mechanism, an inner-sublever 67 which is pivoted to the base 17 via the pin 58. An end 61 of the inner-sublever 67 is engageble with an end 57 of the outer-lever 15. On a supporting member 24 of the outer-lever 15, there is slidably mounted a release-bush or a release member 25 so as to set the movement of the outer-lever 15 relative to (together with) the lift-lever 12 corresponding to the locking (unlocking) position. An output-lever 52 is connected to an output-shaft 68 of the actuator 2 so as to be rotatable therewith. The output-lever 52 is of an L-shaped configulation and has a holding portion 33 at its distal end. The holding portion 33 has an arc-shaped groove 34 whose center coincides with the pawl-pin 9 which is at its unlocking position. Within the groove 34, there is retained the release-bush 25 so as to permit the movement thereof upon rotation of the outer-lever 15. An end of the output-lever 52 is connected to a locking-knob 71. A turn-over spring 27 is disposed between the output-lever 52 and the housing **2*a* of the actuator 2 for retaining the output-lever 52 at the unlocking position or locking position and generating moderate reaction to the operator upon operation. As best shown in FIG. 7, the turn-over spring 27 is disposed between a concave 69 formed near the output shaft 68 and a hole 70 which is formed in the output shaft 68 so as to be in alignment with the concave 69. Rotational force or torque can be transmitted effectively from the actuator 2 to the turn-over spring 27 due to direct connection of the output lever 52 to the output shaft 68. This means that the actuator 2** can be miniatuarized in size and the whole device can also be miniatuarized in size.

Figure 8:
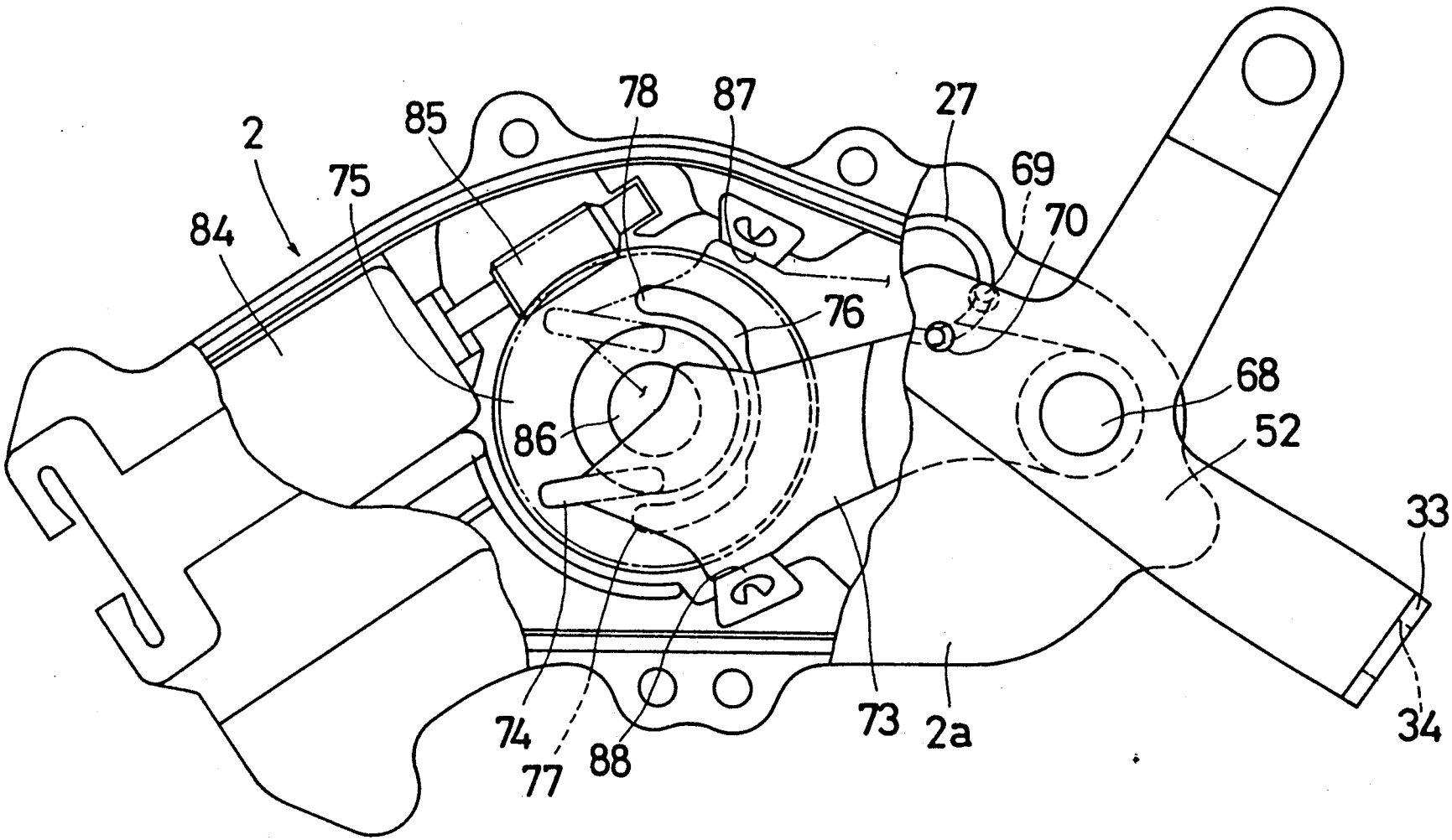
FIG. 8 is a plan view with a partly in cross-section of an actuator.
Figure 9:
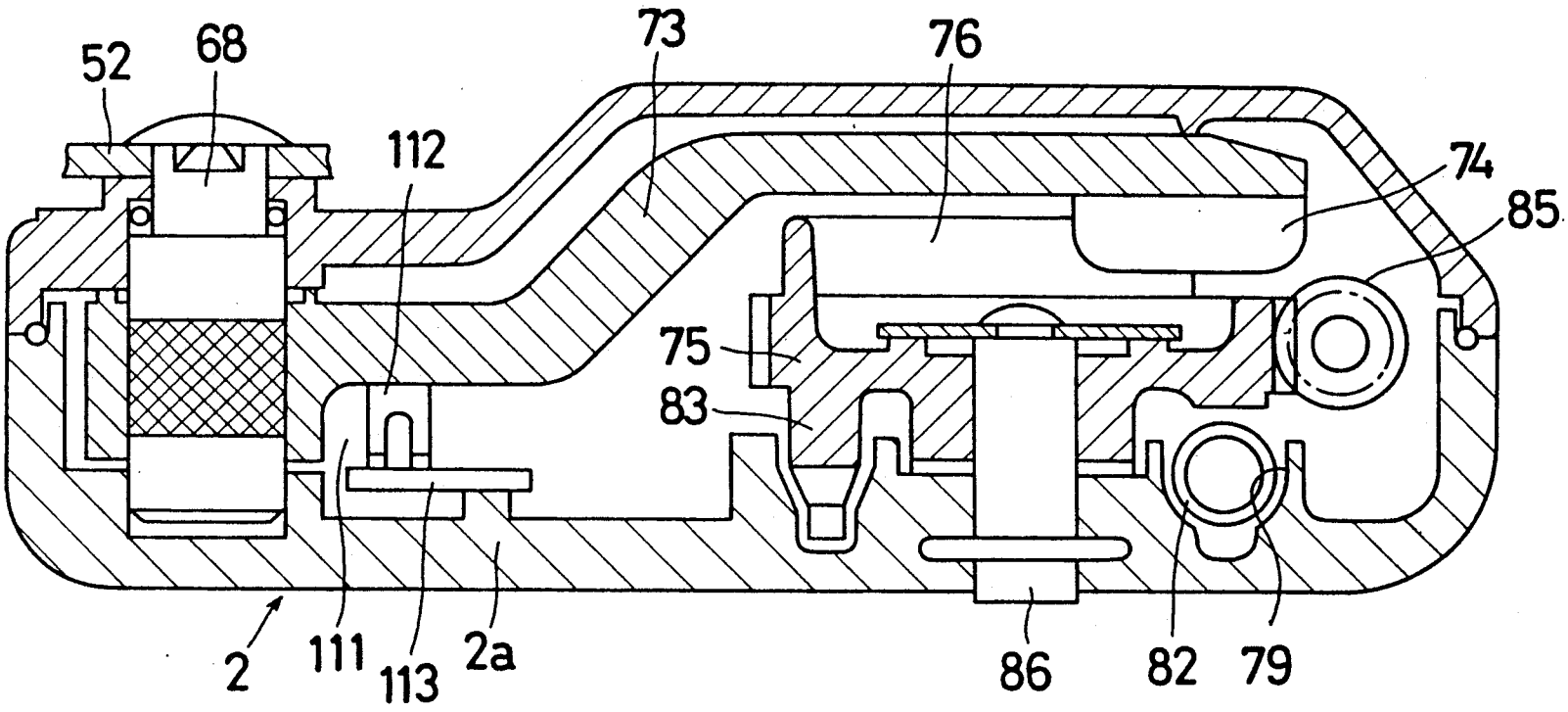
FIG. 9 is a cross-setional view of the actuator in FIG. 8.

The actuator 2 will be detailed hereinafter. As illustrated in FIGS. 8 and 9, the output shaft 68 is connected to an operating lever 73 so that it may be rotatable within the housing **2*a* in which a wheel-gear 75 is rotatable about a pin 86. A projection 76 is provided on the wheel-gear 75 and both ends 77 and 78 of the projection 76 are in opposition with an arm 74 of the operating lever 73. Stoppers 87 and 88 each of which is made of an elastic material, such as a rubber, are provided to the housing 2*a* so as to regulate or limit a rotating range of the operating lever 73, or that of the output lever 52. An annular groove 79 is formed in a bottom of the housing 2*a* in which a coil-spring 82 is accomodated. The groove 79 defined between opposed walls 80 and 81 has a narrowed portion which is defined by a pair of opposed projections or shoulders, each of which is in abutment with one (the other) end of the coil-spring 82. A downward projection 93 of the wheel-gear 75 is also in the groove 79. The wheel-gear 75 is in mesh engagement with a worm-gear 85 which is in direct connection with a motor 84 and is rotated in one or the other direction according to the rotational direction of the motor 84 when turned on. An advancing angle of the worm-gear 85 is set so as to be larger than a frictional angle between the wheel-gear 75 and the worm-gear 85**, thereby enabling transmission of force from the former to the latter and vise versa. Thus, manual locking operation after electrical locking operation, and electrical locking operation after manual and electrical locking operations.

Figure 11:
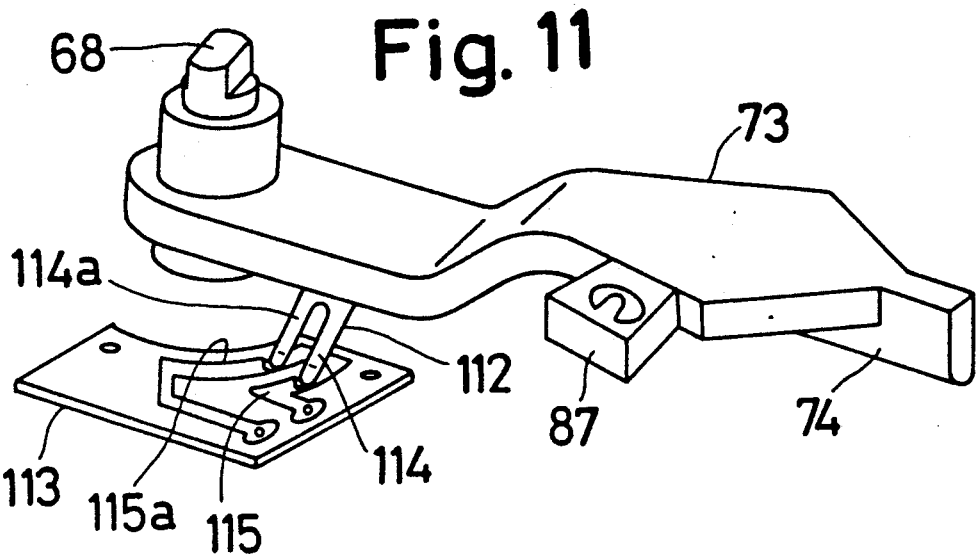
FIG. 11 is a perspective view of a switch.
Figure 12:
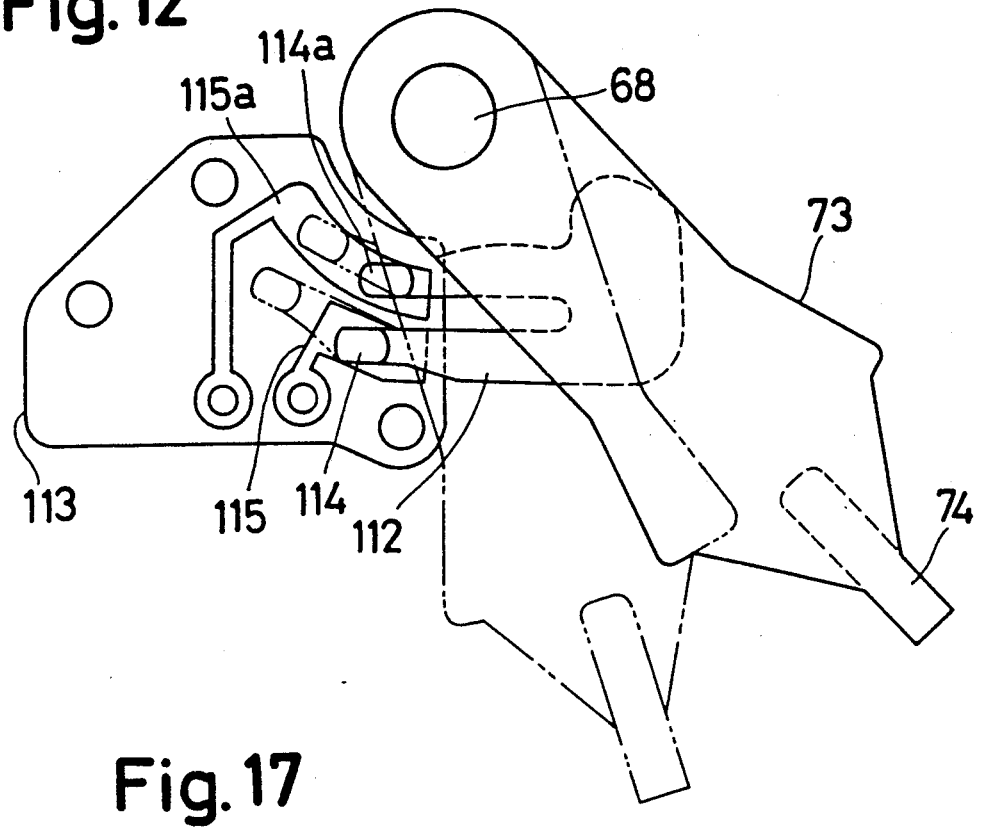
FIG. 12 is a plan view of the switch in FIG. 11.

As shown in FIGS. 9, 11 and 12, a detecting switch is provided in a concave 111 in the housing **2*a* in order to check wether the operating lever 73 or the output lever 52 is in the locked position or the unlocked position. The switch has a contact member 112 with portions 114 and 114*a*; and a base having conductive portions 115 and 115*a* on which the portions 114 and 114*a* slide. In this embodiment, the unlocked condition locked condition is established when a detecting circiut (not shown) is in opened and closed condition wherein portions 114 and 114*a* are in and out of contact with the conductive portions 115 and 115*a***.

Figure 10:
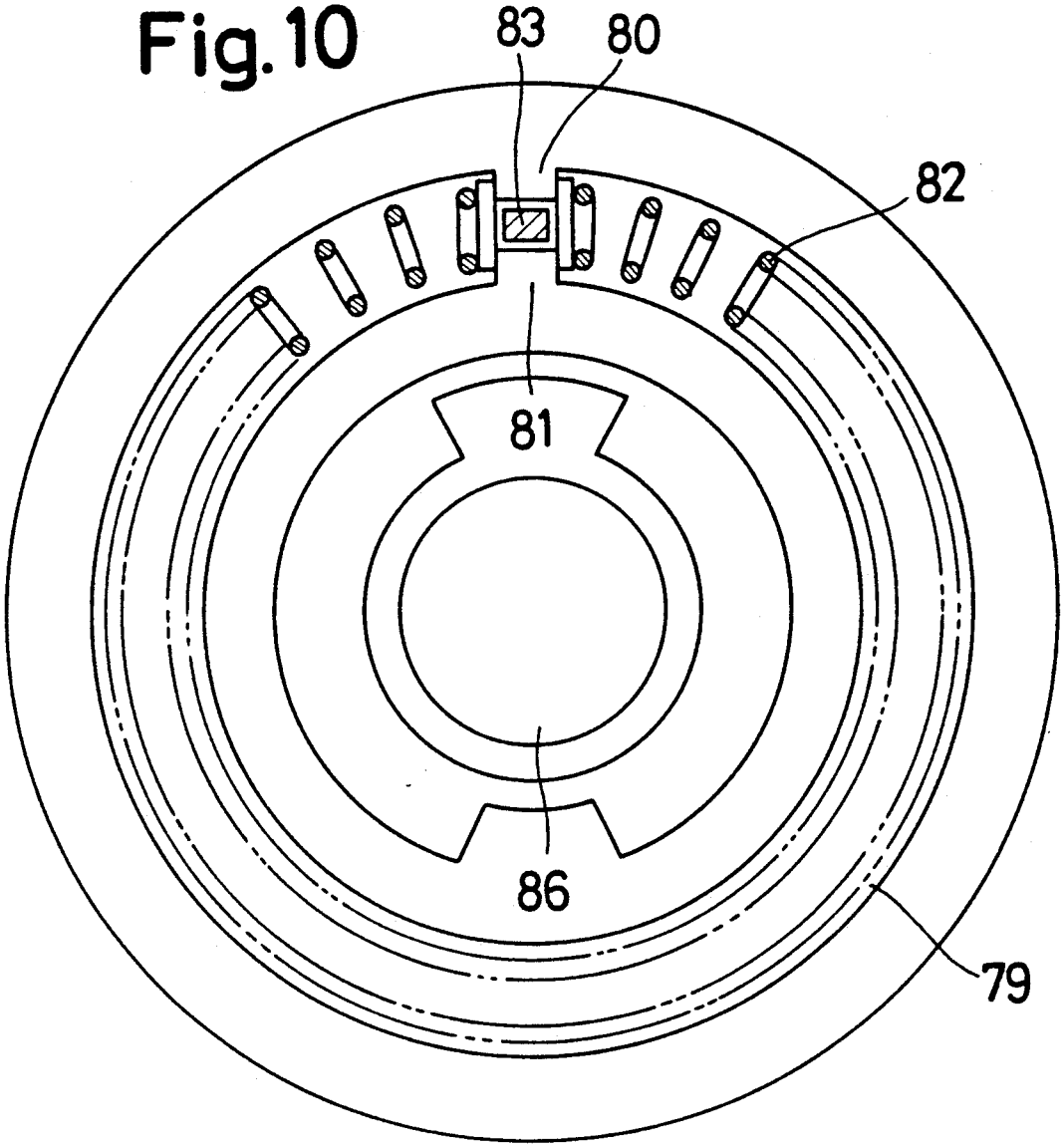
FIG. 10 is a plan view for showing installation condition of a return spring.

In FIGS. 8 through 10, when the wheel-gera 75 is rotated in the clockwise direction (see FIG. 8) due to torque transmission via the worm-gear 85 from the motor 84 when turned on, the coil-spring 82 is compressed since one end and the other end thereof are in abutment with the projection 83 of the wheel-gear 75 and both shoulders. Due to the rotation of the wheel-gear 75, the end 77 of projection 76 is brought into abutment with the arm 74, thereby rotating the operation lever 73 and the output lever 68. Thus, the output lever 52 is transferred from its locked position to its unlocked position. Thereafter, when the motor 84 is turned off, the worm-gear 75 is returned to its original position due to the elastic force of the coil spring 82. When the motor 84 is turned on in a direction which is reverse to the foregoing direction, similar movement is performed wherein the wheel-gear 75 is rotated in the counter-clockwise direction in FIG. 8 and the operating lever 73 and the output lever 68 are rotated. Thus, the output lever 52 is transferred from its unlocked position to its locked position. Thereafter, the wheel-gear 75 is returned to its original position.

Hereinafter, operations of the door-lock device 10 will be described.

Figure 2:
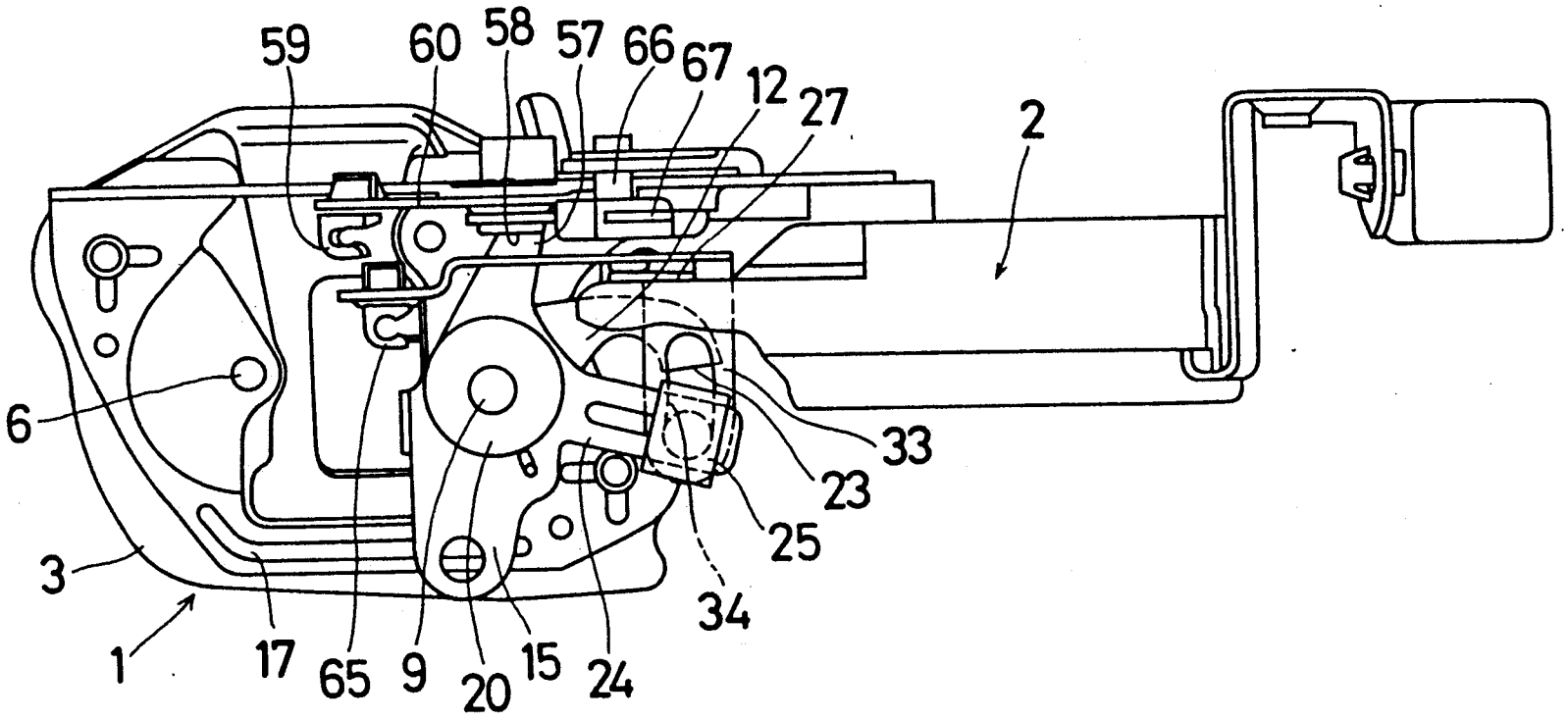
FIG. 2 is a plan view of the device in FIG. 1.

First, an operation for opening the door is described with reference to FIGS. 1, 2, 5 and 6. Under the door-closed condition in FIGS. 1 and 2, upon manipulation of the inside-door handle, the inner lever 60 is rotated through an angle in the clockwise direction in FIG. 1. Resulting rotating force is transmitted from the end 61 of the inner sub-lever 67 to the end 57 of the outer lever 15 via the release-bush 66 of the child-protecting mechanism. Thus, the outer lever 15 is rotated in the counter-clockwise direction as shown in FIG. 2, and is brought into engagement with the end 23 of the lift-lever 12 via the release-bush 25 which is supported on the supporting member 24, thereby rotating the lift-lever 12 in the counter-clockwise direction. Due to resulting rotation of the lift-lever 12, the pawl 8 is rotated in the clockwise direction as shown in FIG. 5 against the biasing force of the pawl-spring 72, the clawed portion 11 of the pawl 8 is disengaged from the clawed portion 10 of the latch 5, and the latch 5 is rotated in the clickwise direction as shown in FIG. 5 due to the biasing force of the latch-spring 7. Then, the door is ready for opening.

Figure 3:
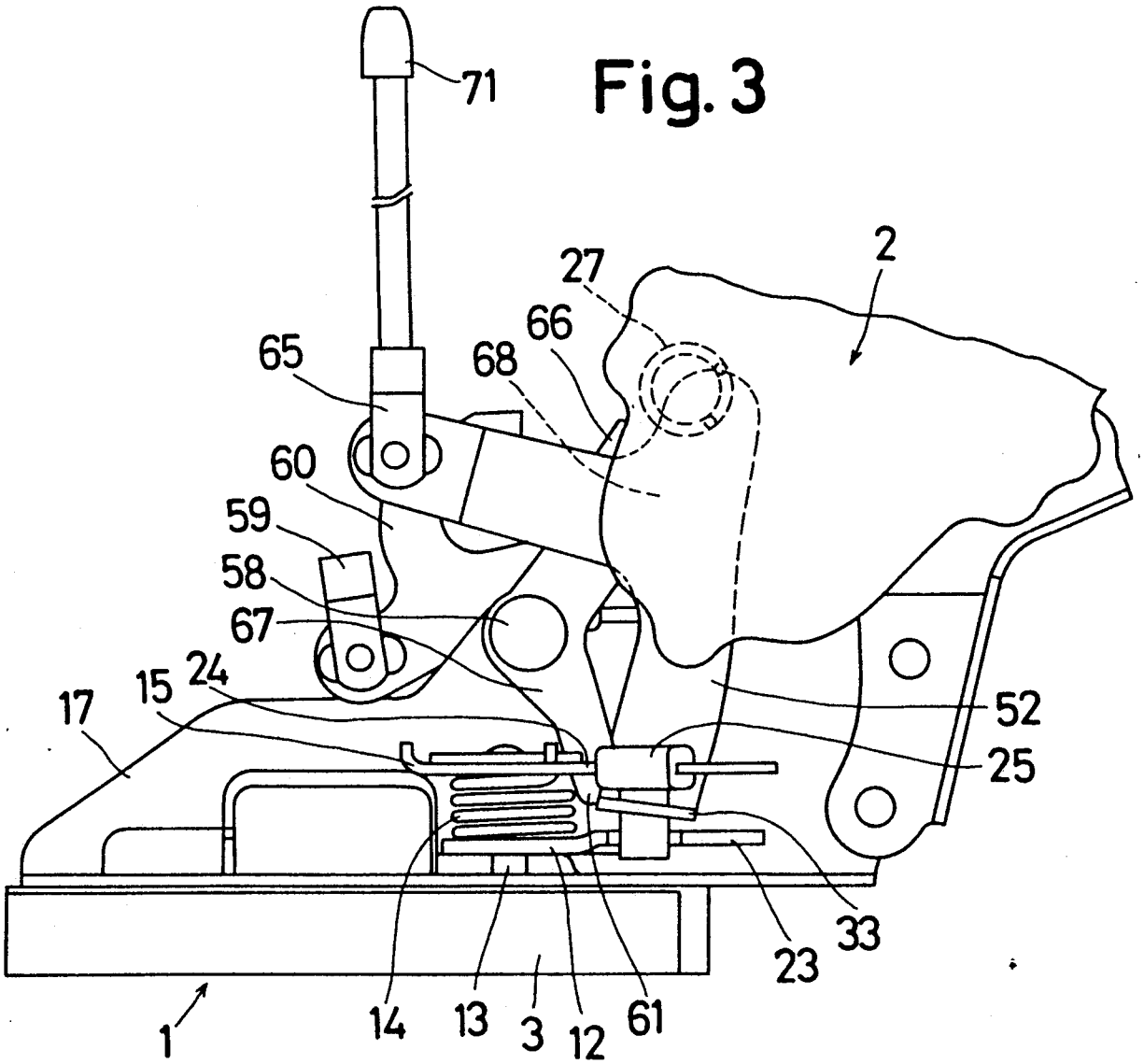
FIG. 3 is a front view of the device in FIG. 1 after operation of an output lever.
Figure 4:
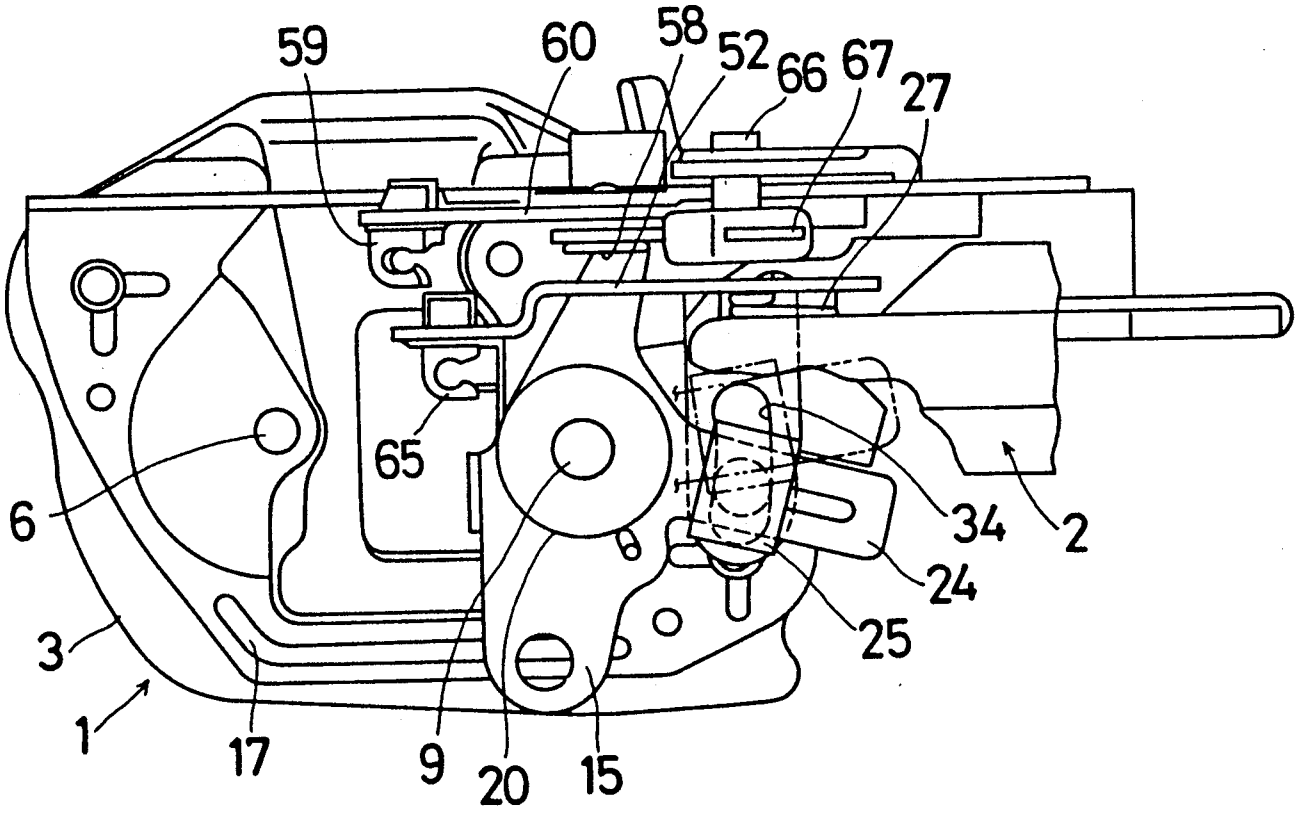
FIG. 4 is a plan view of the device in FIG. 2.

Next, with reference to FIGS. 1 through 4, manual transfer from the unlocked condition to the locked condition is described. Upon manipulation of the locking-knob 71 under the condition shown in FIGS. 1 amd 2, the output lever 52 is rotated in the clockwise direction as shown in FIG. 3. Then, the release-bush 25 is moved on the guide-member 24 by the holding-member 33 as shown in FIG. 4 and the release-bush 25 is brought into disengagement with the end 23 of the lift-lever 12. Thus, the door can't be opened despite the rotating operation of the outer-lever 15. Though the rotating force of the output lever 52, due to the manual operation thereof, is also transmitted to the actuator 2, due to the operating separation between the operating-lever 73 and the wheel-gear 75, the arm 74 of the operating-lever 73 makes an idle movement between the oppsite ends 77 and 78 of the concaved portion 76. Thus, the locking-knob 71 can be operated in smooth manner.

An electrical transfer from the unlocked condition to the locked condition is described with in referring to FIGS. 1 through 4. When the motor 84 is turned on in the direction of the door-locking, the output shaft 68 is rotated due to the operation of the actuator 2, and the output lever 52 is rotated in the clockwise direction of FIG. 1 with the result that the release bush 25 is moved on the supporting-member 24 of the outer-lever 15 by the holding member 33 as shown in FIG. 4. The successive operation is similar to the foregoing manual operation. Also, electrical rotation of the output-lever 52 is transmitted via the bush 65 to the locking-knob 71, thereby transfering the locking-knob 71 to its locked position.

Figure 13:
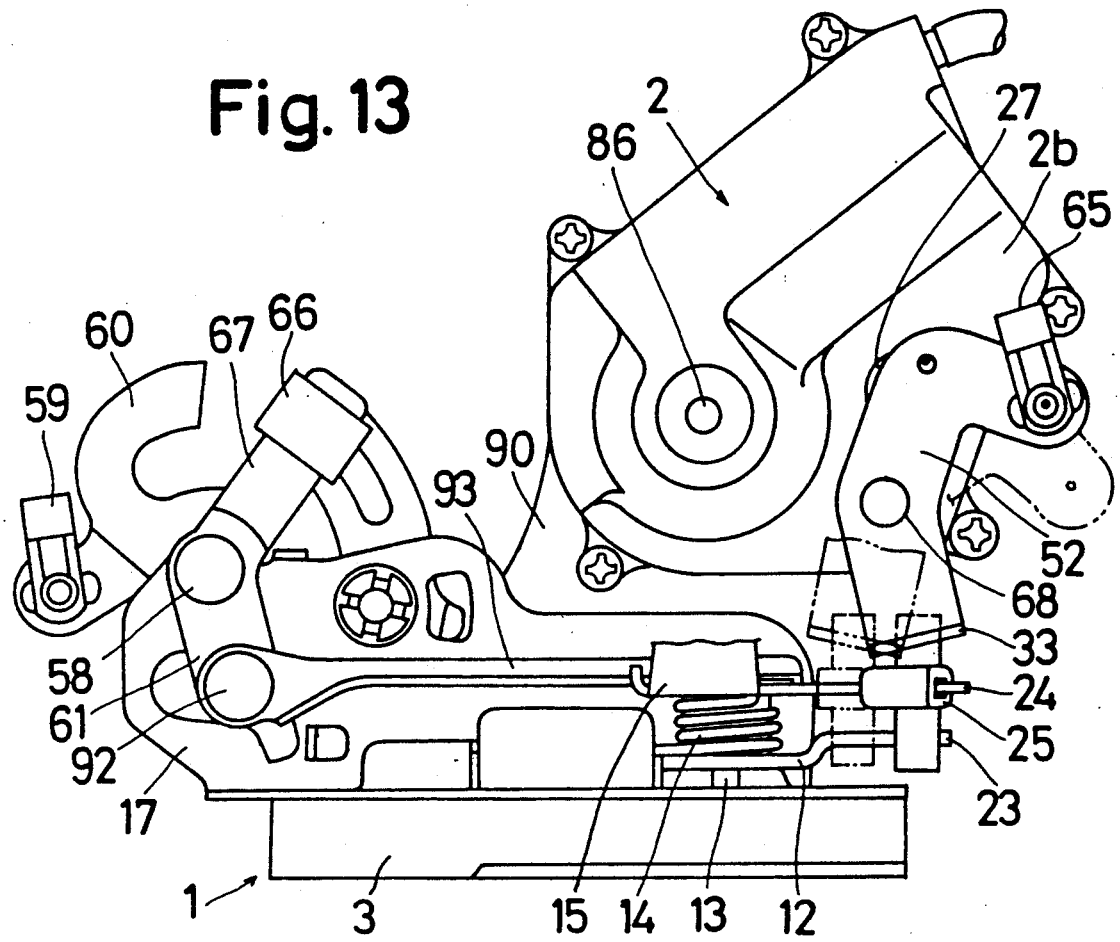
FIG. 13 is a front view of a second embodiment of a door-locking device according to the present invention.
Figure 14:
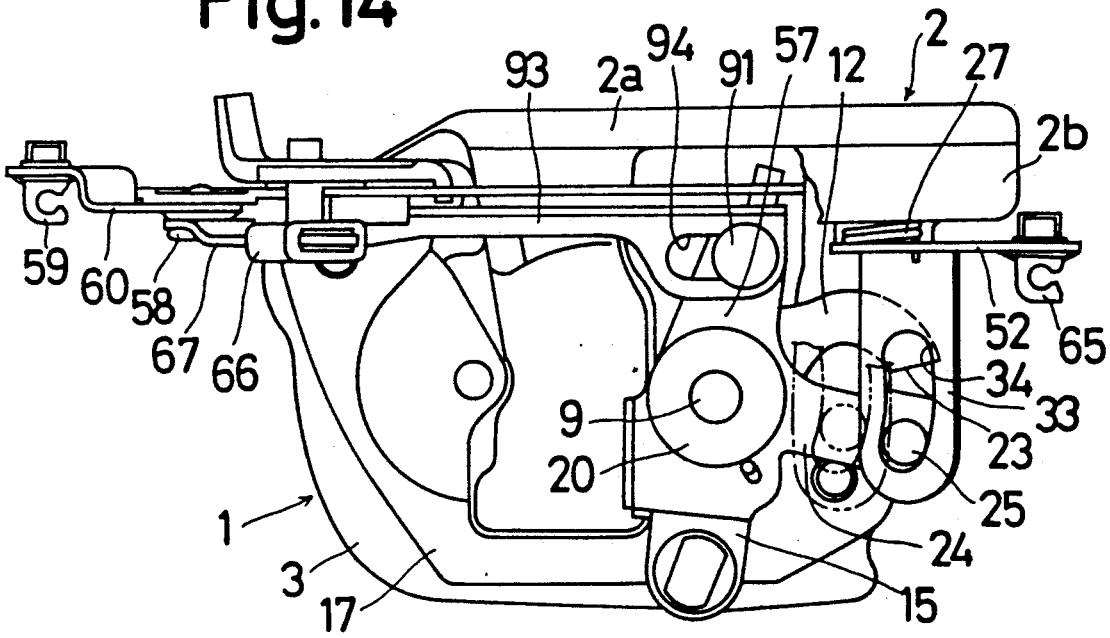
FIG. 14 is a plan view of the device in FIG. 13.
Figure 15:
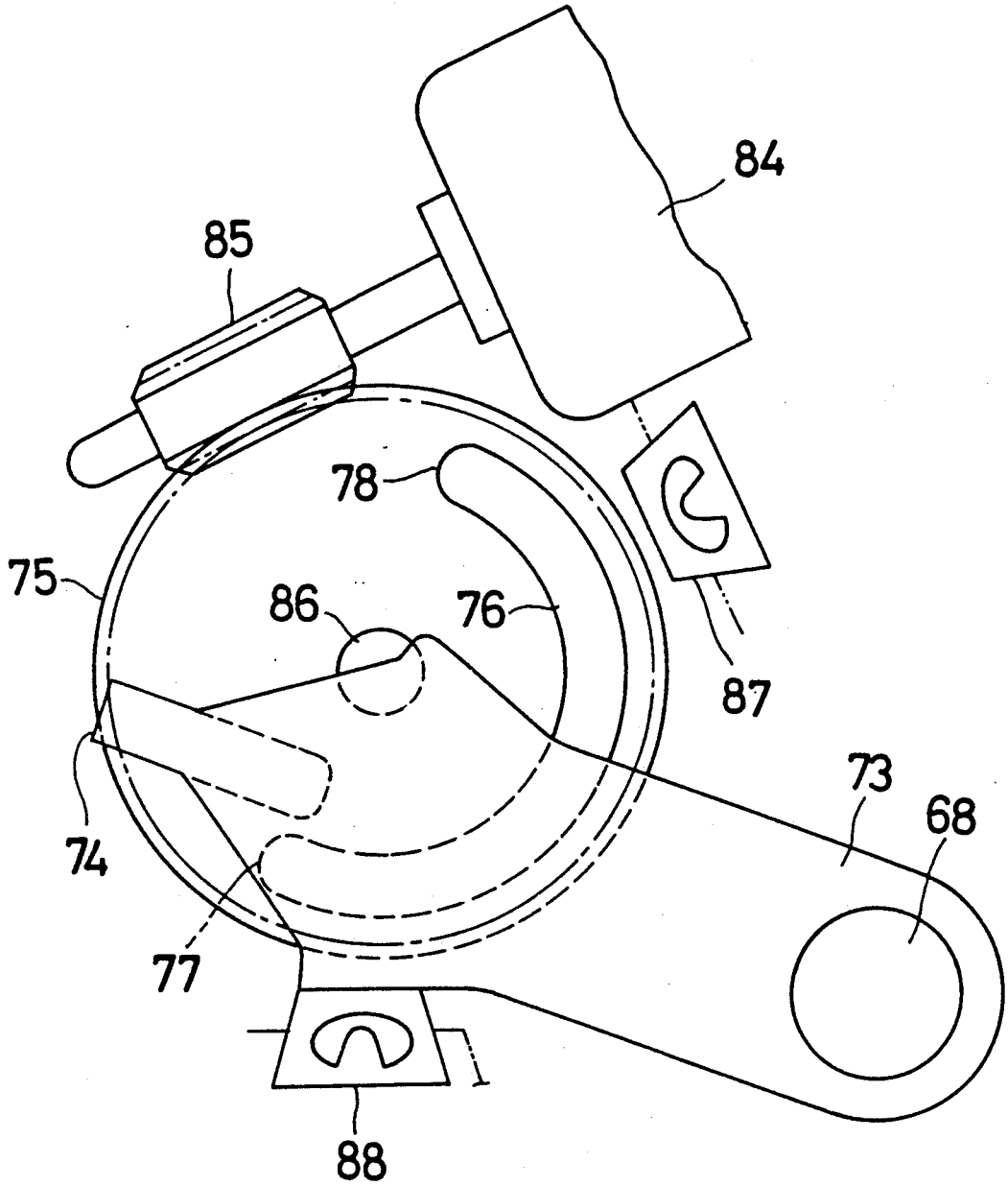
FIG. 15 is a plan view partly in cross-section of an actuator.

Hereinafter, a second embodiment of the present invention will be described with reference to FIGS. 13 through 15 in such manner that the diferrence between the first embodiment and the second embodiment is emphasized, and common construction therebetween is omitted. As shown in FIGS. 13 and 14, an extension 90 of the body 3 is connected integrally with the housing **2*b* of the actuator 2, and the portion of housing 2*b* is coupled with another housing 2*a* by means of suitable means such as screws, thereby defining an inner space therebetween in which the driving mechanism is accomodated. As shown in FIG. 15, the motor 84 is so positioned as to be near the extension as possible for avoiding the shock which occurs upon door-opening or door-closure. Due to this arrangement of the motor 84, the inner-lever 60 is positioned at the left side as shown in FIGS. 13 and 14. Thus, the end 61 of the inner-sub-lever 67 which is operatively connected to the inner-lever 60 via the release-bush 66 of the well-known child-protecting mechanism, is connected to the end of the outer lever 15 via the open-link 93. The open-link 93 is connected to the end 57 of the outer-lever 15 (the slot 94 of the innerinner-sublever 67) via the pin 91 (the pin 92**).

In opening the door according to the second embodiment, upon the manupilation of the inside-handle under the door-closed condition as shown in FIGS. 13 and 14, the inner-lever 60 is rotated in the clockwise direction of FIG. 13 and the resulting rotation is transmitted to the inner-sublever 67 via the release-bush 66 of the child-protecting mechanism, thereby rotating the inner-sublever 67 in the clockwise direction of FIG. 13. Due to this rotation of the inner-sublever 67, the open-link 93 is moved in the leftward direction in FIG. 13, thereby transmitting the foregoing rotation to the outer-lever 15. The successive operation is omitted because it is similar to that of the first embodiment. The manual operation is also omitted.

Figure 17:
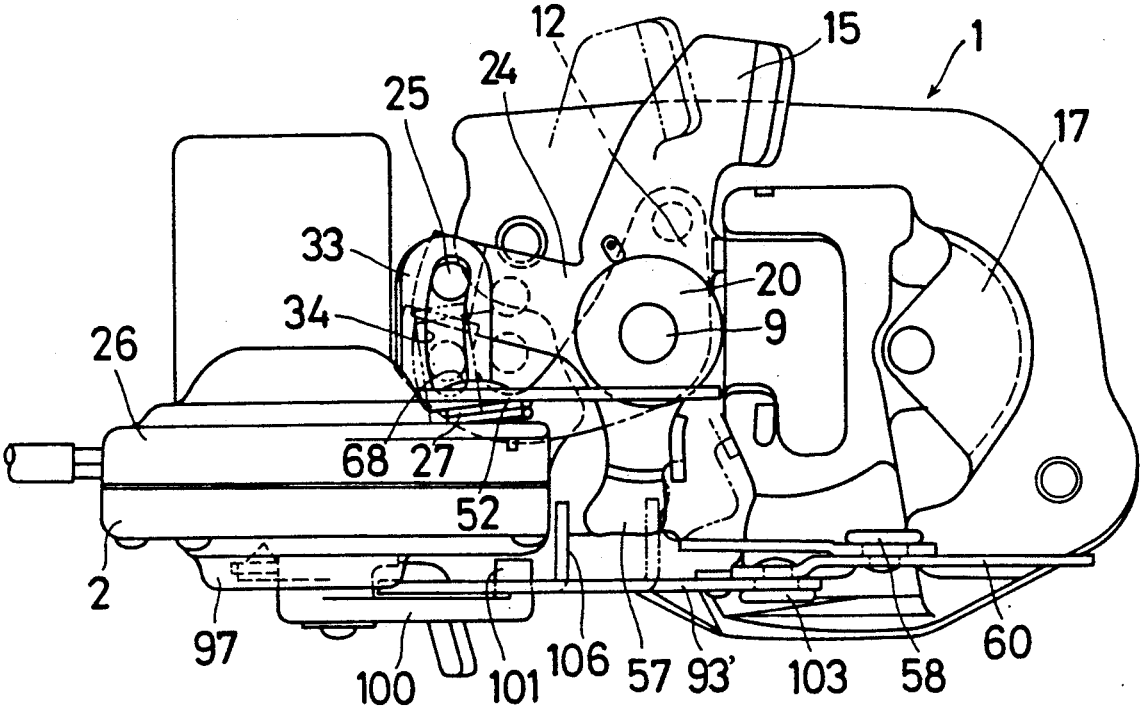
FIG. 17 is a plan view of the device in FIG. 17.
Figure 16:
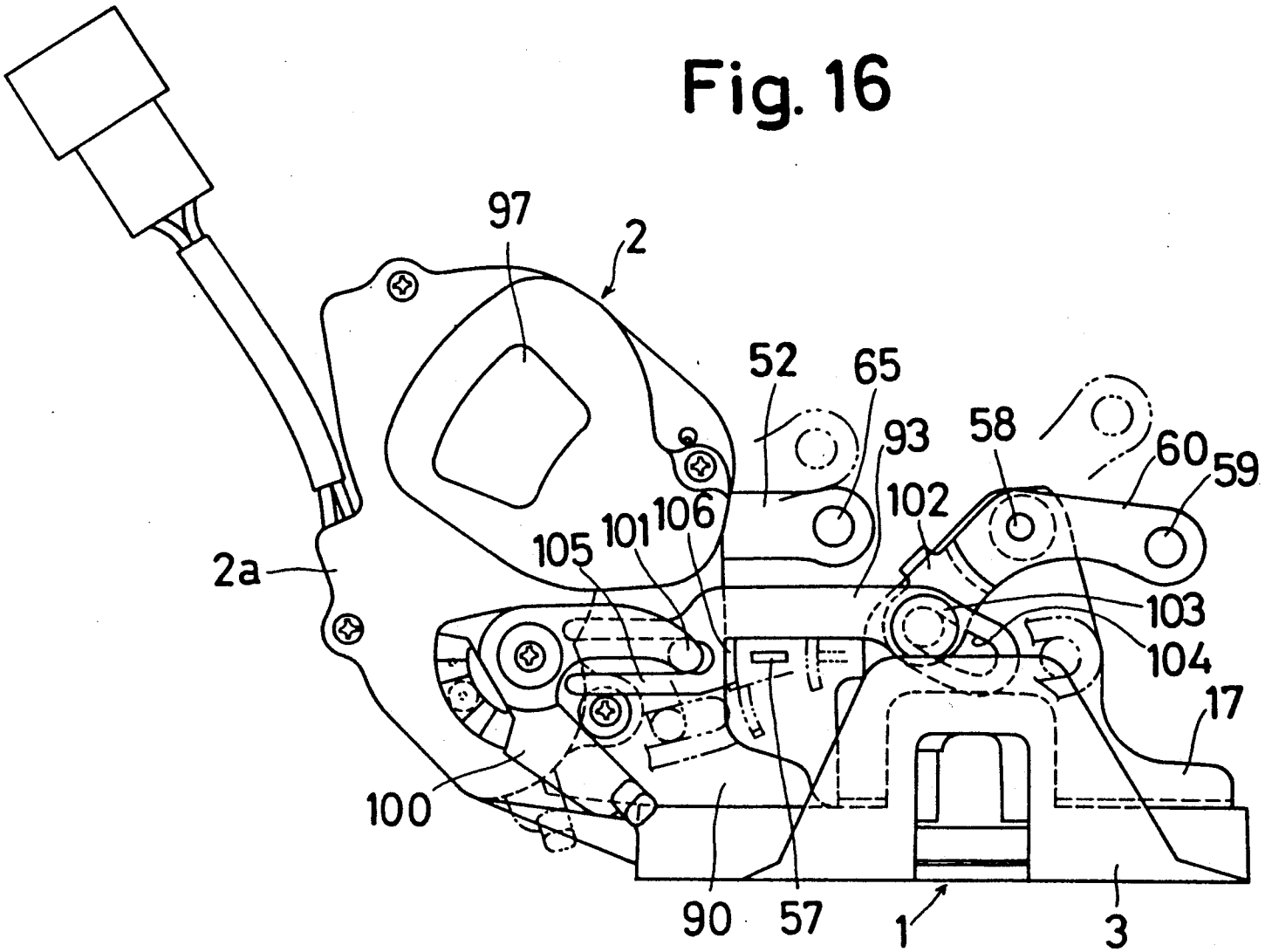
FIG. 16 is a front view of a third embodiment of a door-locking device according to the present invention.
Figure 18:
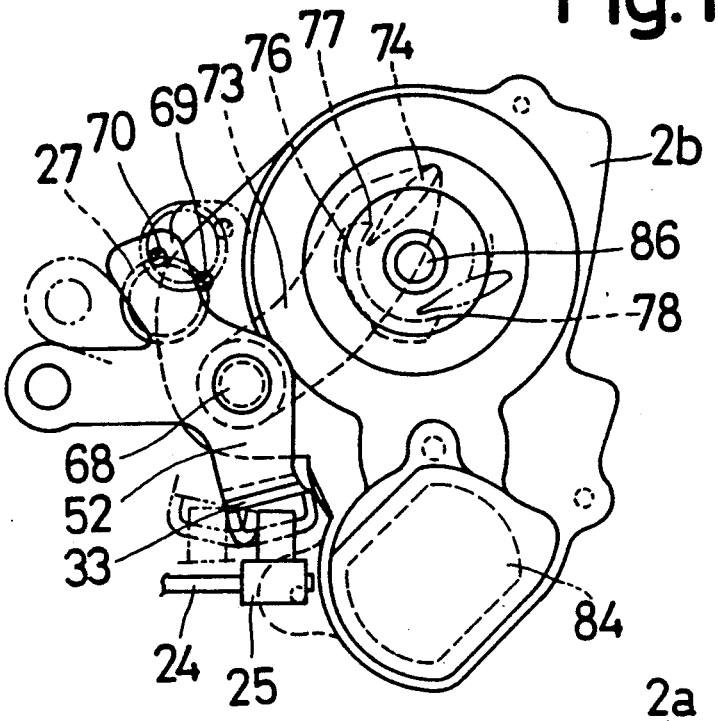
FIG. 18 is a plan view of an actuator.
Figure 19:
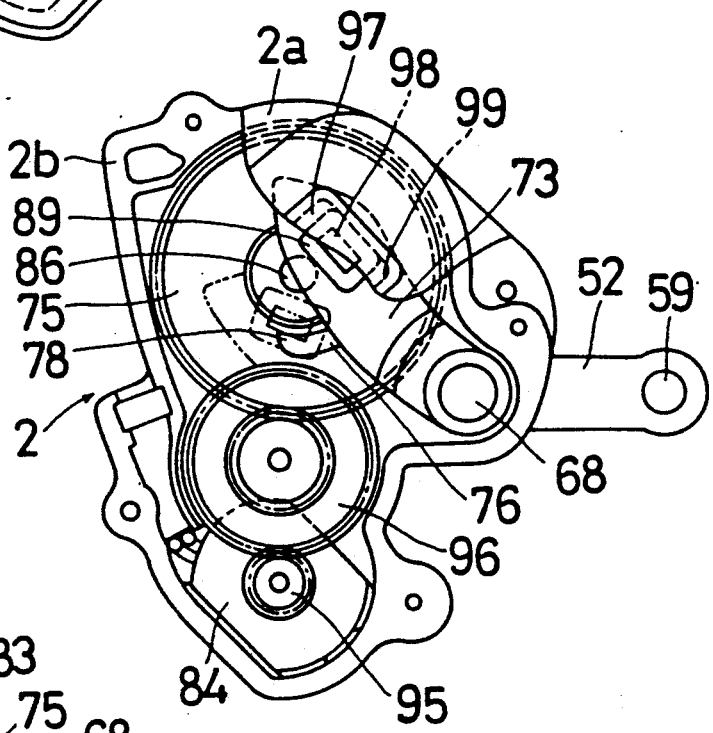
FIG. 19 is a partial cross-sectional view of the actuator as seen from the backside in FIG. 18.
Figure 20:
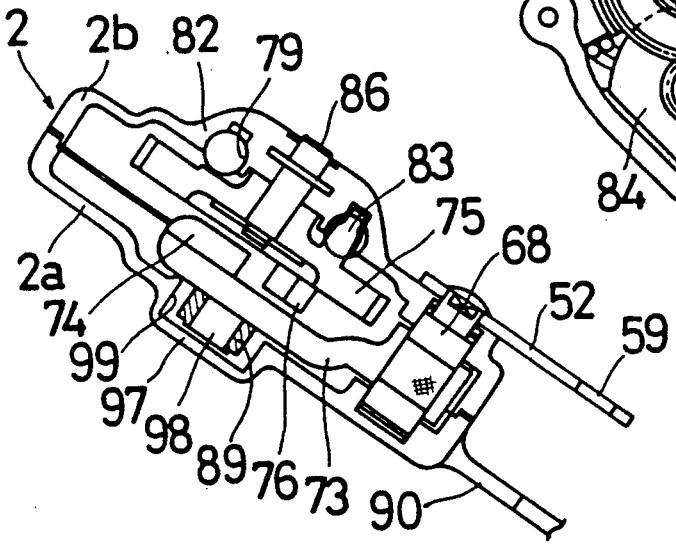
FIG. 20 is a cross-sectional view of the actuator in FIG. 19.

A third embodiment of the present invention which is the modification of the second embodiment thereof is described hereinafter with reference to FIGS. 16 through 20. As shown in FIGS. 16 and 17, the body 3 is integrally attached to the housing **2*b* to which the housing 2*a* is connected; and the driving mechanism is accomodated within the inner space defined by both housings 2*a* and 2*b*. As shown in FIGS. 18 through 20, the motor 84 is positined in parallel relationship to the output-shaft 68 so as to be closer to the extension 90 when compared with the second embodiment. Under this arrangement, the gear 95 on the motor 84 is operatively connected to the wheel-gear 75 via the idle-gear 96. The stopper for regulating the rotational angle of the operating-lever 73 is constituted by an elastic member 89, such as a rubber member, on the holding member 98 driven on the operating-lever 73 and the side-wall 99 of the space 97 in the housing 2*a*. Due to this construction, the actuator 2** can be minituarized in comparison to the first and second embodiments.

As shown in FIGS. 16 and 17, due to the positioning of the motor 84 near the extension 90, the inner-lever 60 is positioned at a rightward portion in FIG. 16. The child-protecting mechanism includes a child-lever 100; and the open-link 93 has one end connected to the end 102 of the inner-lever 60 via the pin 103 and the slot 104, and the other end connected to the child-lever 100 via the pin 101. The abutting portion 106 of the open-limk 93 is in opposition to the end 57 of the outer-lever 15 so as to be engageble therewith. Such construction can eliminate the inner-sublever 61 and the release-bush 66 in the second embodiment.

In operation, upon manipulation of the inside-handle, the inner-lever 60 is rotated in the clockwise direction of FIG. 16. Due to this rotation, the open-link 93 is moved in the rightward direction in FIG. 16 and the abutting portion 106 is abutted to the end 57, thereby transmitting the foregoing rotation to the outer-lever 15. Further operation is omitted due to the similarity to that of the first embodiment.

Figure 21:
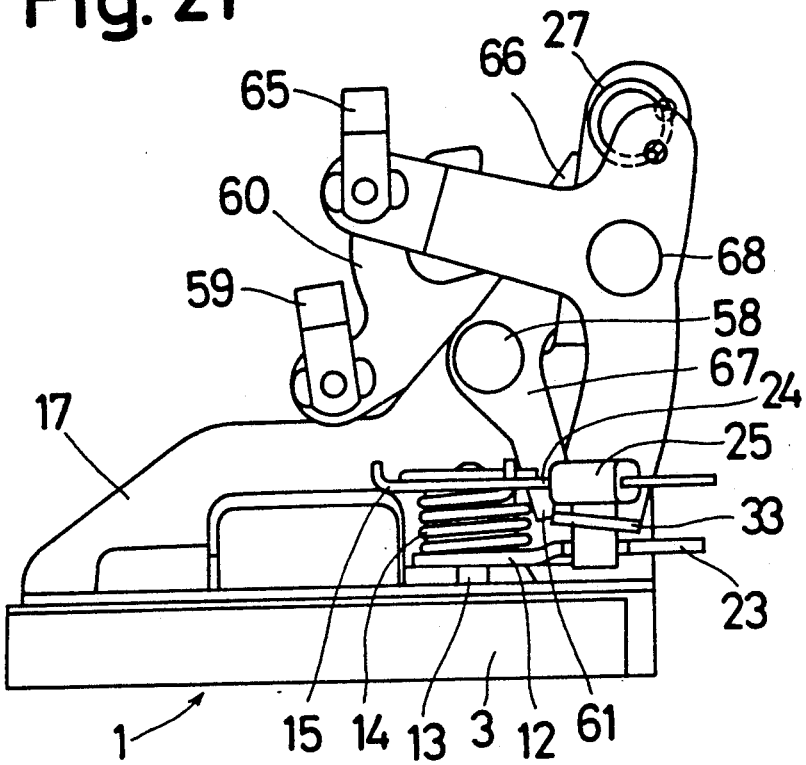
FIG. 21 is a front view of a fourth embodiment of a door-locking device according to the present invention.
Figure 22:
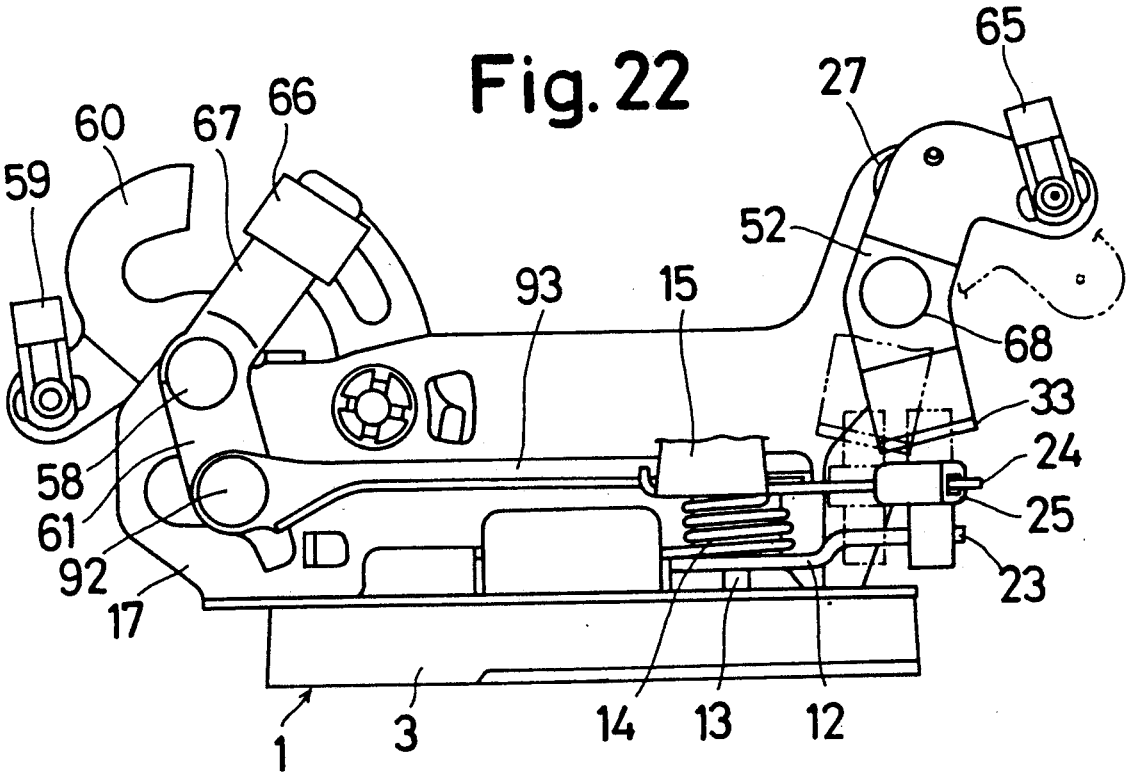
FIG. 22 is a front view of a fifth embodiment of a door-locking device according to the present invention.
Figure 23:
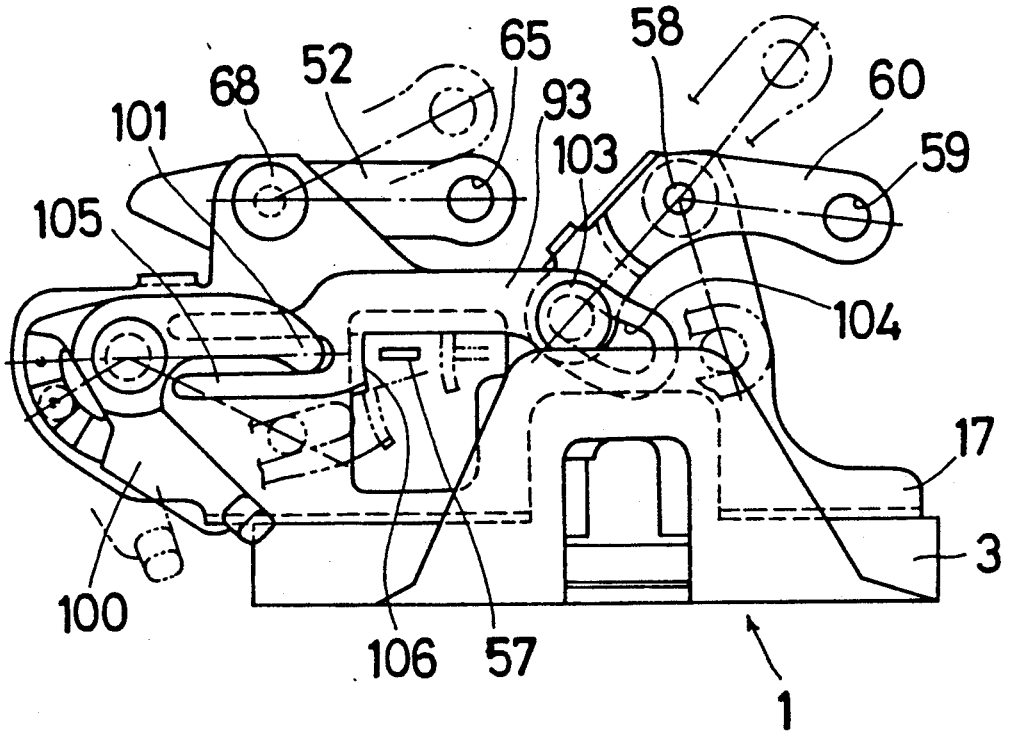
FIG. 23 is a front view of a sixth embodiment of a door locking device according to the present invention.
Figure 24:
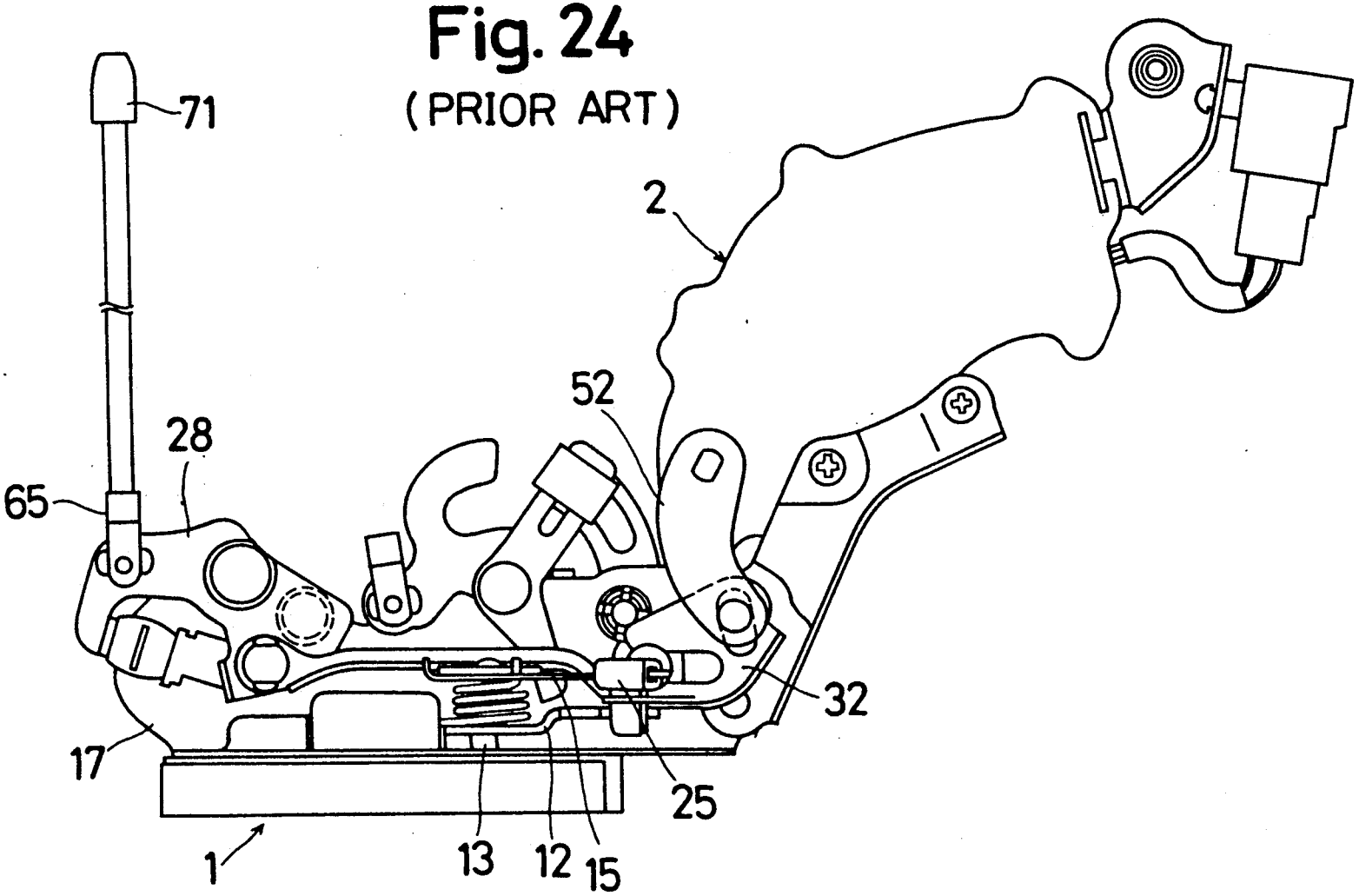
Fig. 24 (PRIOR ART)
FIG. 24 is a front view of a conventional door-locking device.
Figure 25:
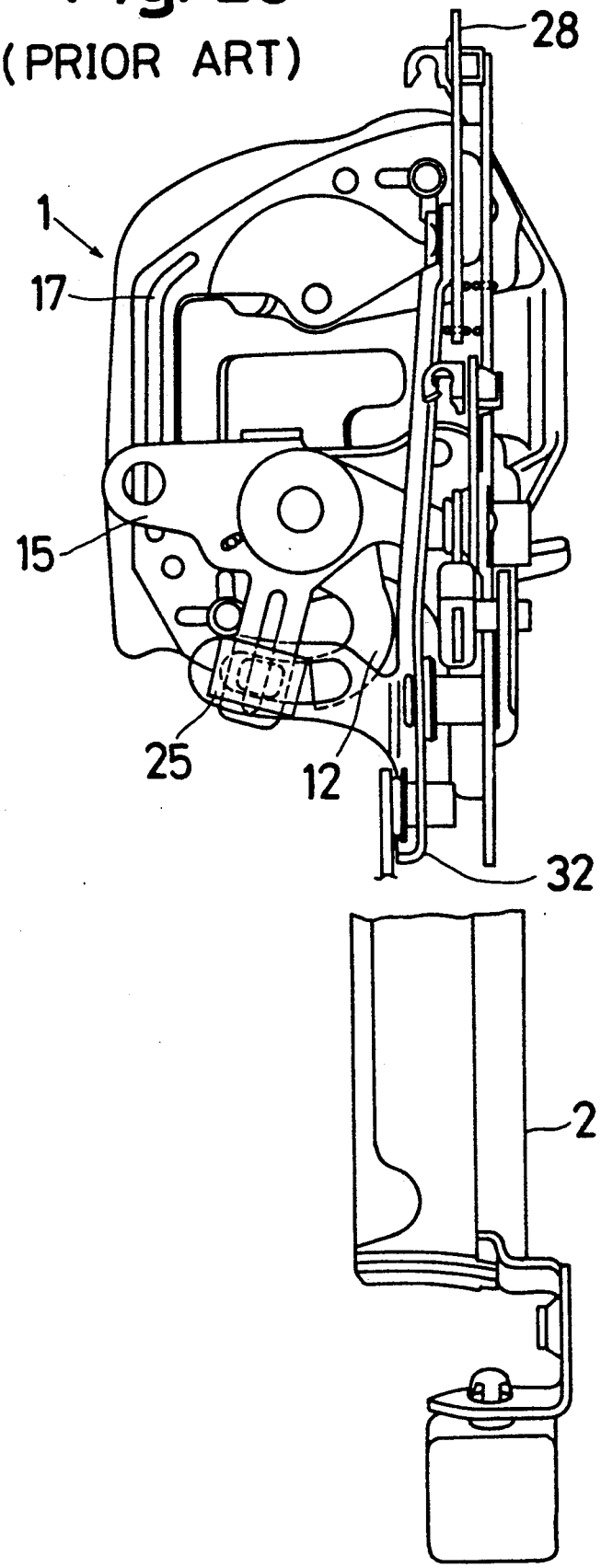
Fig. 25 (PRIOR ART)
FIG. 25 is a plan view of the device in FIG. 24.

A fourth embodiment, a fifth embodiment and a sixth embodiment are illustrated in FIG. 21, FIG. 22 and FIG. 23, respectively, and are manually operated devices similar to foregoing, first, second and third embodiments. In each embodiment, an output lever 52 is rotatably mounted on a base 17 via an output shaft 68, and a turn-over spring 27 is disposed between the base 17 and the output lever 52.

Having now fully described the invention, it will be apparent to one of ordinary skill in the art that many changes and modifications can be made thereto without departing from the sprit or scope of the invention as set forth herein.

What is claimed is:

1. A door-locking device comprising:

a main body accommodating therein a mechanism for opening and closing a door, said mechanism including a pawl member rotatably mounted on a pawl pin;

a base mounted on the main body;

a lift-lever rotatably mounted on the base for operating the opening and closing mechanism;

an outer-lever rotatably mounted on the pawl pin; for at times transmitting rotation to the lift lever;

a release member movably mounted on the outer-lever, said release member being engageable and disengageable with the lift lever for enabling and interrupting, respectively, the transmission of rotation of the outer-lever to the lift lever; and an output lever rotatably mounted on an axis extending substantially perpendicular to the axis of the pawl pin; said output lever having a holding portion at an end thereof extending substantially perpendicular to the axis of the pawl pin connected to the release member for moving the release member into and out of engagement with the lift lever to enable and interrupt, respectively, the transmission of rotation by said outer-lever.

2. A door locking device according to claim 1 further comprising:

an actuator including an operating lever rotatably mounted on the axis of the output lever for operating the output lever.

3. A door locking device according to claim 2, further comprising:

an actuator housing enclosing the actuator, the main body and said housing being formed integrally with each other.

* * * * *